US010792663B2

(12) United States Patent
Lyman

(10) Patent No.: US 10,792,663 B2
(45) Date of Patent: Oct. 6, 2020

(54) MULTI-BLADE HAMMER ASSEMBLY

(71) Applicant: Mark Gerlinger Lyman, Salem, OR (US)

(72) Inventor: Mark Gerlinger Lyman, Salem, OR (US)

(73) Assignee: WEST SALEM MACHINERY COMPANY, Salem, OR (US)

( * ) Notice: Subject to any disclaimer, the term of this patent is extended or adjusted under 35 U.S.C. 154(b) by 670 days.

(21) Appl. No.: 15/286,510

(22) Filed: Oct. 5, 2016

(65) Prior Publication Data

US 2017/0095821 A1 Apr. 6, 2017

Related U.S. Application Data

(60) Provisional application No. 62/237,073, filed on Oct. 5, 2015.

(51) Int. Cl.
*B02C 13/28* (2006.01)
*B02C 13/04* (2006.01)

(52) U.S. Cl.
CPC ..... *B02C 13/04* (2013.01); *B02C 2013/2808* (2013.01); *B02C 2210/02* (2013.01)

(58) Field of Classification Search
CPC ..... B02C 13/04; B02C 2013/2808; B02C 2210/02
See application file for complete search history.

(56) References Cited

U.S. PATENT DOCUMENTS 5,381,976 A * 1/1995 Chon ..... B02C 13/28 241/197
5,950,945 A * 9/1999 Schaller ..... B02C 13/28 241/189.1
6,840,471 B2 * 1/2005 Roozeboom ..... B02C 13/06 241/197
7,281,676 B1 * 10/2007 Bennington ..... A01G 23/093 241/294
7,726,594 B2 * 6/2010 Smith ..... B02C 13/06 241/294
7,753,302 B2 * 7/2010 Zollig ..... B02C 13/14 241/195
9,108,202 B2 * 8/2015 Stegelitz ..... B02C 13/26
9,327,287 B2 * 5/2016 Doppstadt ..... B02C 13/04
10,441,956 B2 * 10/2019 Furtado ..... B02C 19/0043
(Continued)

*Primary Examiner* — Omar Flores Sanchez
(74) *Attorney, Agent, or Firm* — White-Welker & Welker, LLC; Matthew T. Welker, Esq.

(57) ABSTRACT

A hammer assembly that will mount in a grinder/shredder/hammer mill type machine. A tool holder is milled with dovetail/angular slots along each side of the hammer tool holder, which allows milled blade to slide in to place and be securely held in position. The simple milled slot located in the middle of each blade that allows a single mounting block/bolt to securely hold each blade in position. This results in the ability to rotate and/or interchange blades. The tool holder allows single or multiple blade/hammer inserts to be installed without having to remove a hammer pin, so the tool holder stays in the machine, and the blades can be easily removed. This arrangement allows the tool holder to stay in place, and enables the simple removal of a single bolt and retention block and then flip or rotate the hammer to get additional wear surfaces or install new blades.

12 Claims, 17 Drawing Sheets

(56) References Cited

U.S. PATENT DOCUMENTS

| | | | | |
|---|---|---|---|---|
| 2009/0159732 | A1* | 6/2009 | Zollig | B02C 13/14<br>241/194 |
| 2013/0168477 | A1* | 7/2013 | Doppstadt | B02C 13/04<br>241/197 |
| 2013/0181079 | A1* | 7/2013 | Stegelitz | B02C 13/26<br>241/191 |
| 2015/0314297 | A1* | 11/2015 | Roska | B02C 13/04<br>241/195 |
| 2015/0314298 | A1* | 11/2015 | Porter | B02C 13/04<br>241/197 |
| 2016/0288131 | A1* | 10/2016 | Esbelani | B02C 13/1835 |
| 2016/0367995 | A1* | 12/2016 | Birtch | B02C 4/305 |
| 2017/0008005 | A1* | 1/2017 | Roth | B02C 18/18 |
| 2017/0087558 | A1* | 3/2017 | Davis | B02C 4/305 |
| 2017/0106374 | A1* | 4/2017 | Ha | B02C 13/14 |
| 2018/0071743 | A1* | 3/2018 | Olsson | B02C 2/005 |
| 2019/0001336 | A1* | 1/2019 | Lutoslawski | B02C 13/18 |
| 2019/0201910 | A1* | 7/2019 | Dallimore | B02C 13/2804 |

* cited by examiner

MULTI-BLADE HAMMER ASSEMBLY

CROSS REFERENCE TO RELATED APPLICATIONS:

This application claims priority from U.S. Patent Application Ser. No. 62/237,073, entitled Multi-Blade Hammer Assembly, filed on 05 Oct. 2015. The benefit under 35 USC § 119(e) of the United States provisional application is hereby claimed, and the aforementioned application is hereby incorporated herein by reference.

TECHNICAL FIELD OF THE INVENTION

The present invention relates generally to a grinder/shredder/hammer mill type machine. More specifically, the present invention relates to a grinder/shredder/hammer mill type machine having a rotating internal assembly to which a plurality of swinging hammers are affixed using pins.

BACKGROUND OF THE INVENTION

Hammer mills come equipped with different hammer and screen configurations to best suit production requirements. Operating speeds range from 1000-3600 rpm, allowing Hammer mills to handle a broad range of different product sizes and extend your capabilities. At these speeds aerodynamics comes into play and it would be advantageous to have a hammer which reduces the amount of energy lost to draft, which results in a lower operating expense.

Hammers also handle the brunt of reducing product from its feed size down to a more manageable, reduced sized for recycling or secondary usage. The hammers in such a machine take considerable abuse and are quickly worn, even when made from the highest quality alloys available. Therefore, what is needed is a tool for holding the blades that allows for quick and easy changing or rotating of cutting side to increase hammer life and effectiveness. Additionally, if such a tool enables fix or swinging hammer function with an easy and quick adjustment, that would be beneficial in changing the reduction characteristics of the machine making it more efficient and more versatile.

SUMMARY OF THE INVENTION

The present invention is a hammer assembly that will mount in a grinder/shredder/hammer mill type machine. Of the possible grinding/shredding/milling type machines that this hammer assembly could be used in, all of them have a rotating element with pins to hold the hammer assembly in place. Sometimes the hammer will have a single pin (allowing the hammer to swing) and sometimes two pins, make the hammer fixed.

The present invention can be differentiated from the prior art systems with respect to a focus on the tool holder that allows single or multiple blade/hammer inserts to be installed without having to remove a hammer pin, so the tool holder stays in the machine, and the blades can be easily removed. In the present invention, a user can simply remove a single bolt and retention block and then flip or rotate the hammer to get additional wear surfaces or install new blades.

The difference between the hammer of the present invention and the more recent hammers is that the hammer of the present invention uses a tool holder that allows single or multiple blade/hammer inserts to be installed without having to remove a hammer pin. So the tool holder stays in the machine, and the blade(s) can be easily removed. These types of machines can have 200-400 hammers and it is a real time-consumer to pull out the hammer pins and re-insert the hammers back on the hammer pins.

Comparing the prior art to the present invention, the present invention's arrangement allows the tool holder to stay in place, and enables the simple removal of a single bolt and/or retention block and then flip or rotate the hammer to get additional wear surfaces or install new blades.

BRIEF DESCRIPTION OF THE DRAWINGS

The accompanying drawings, which are incorporated herein a form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
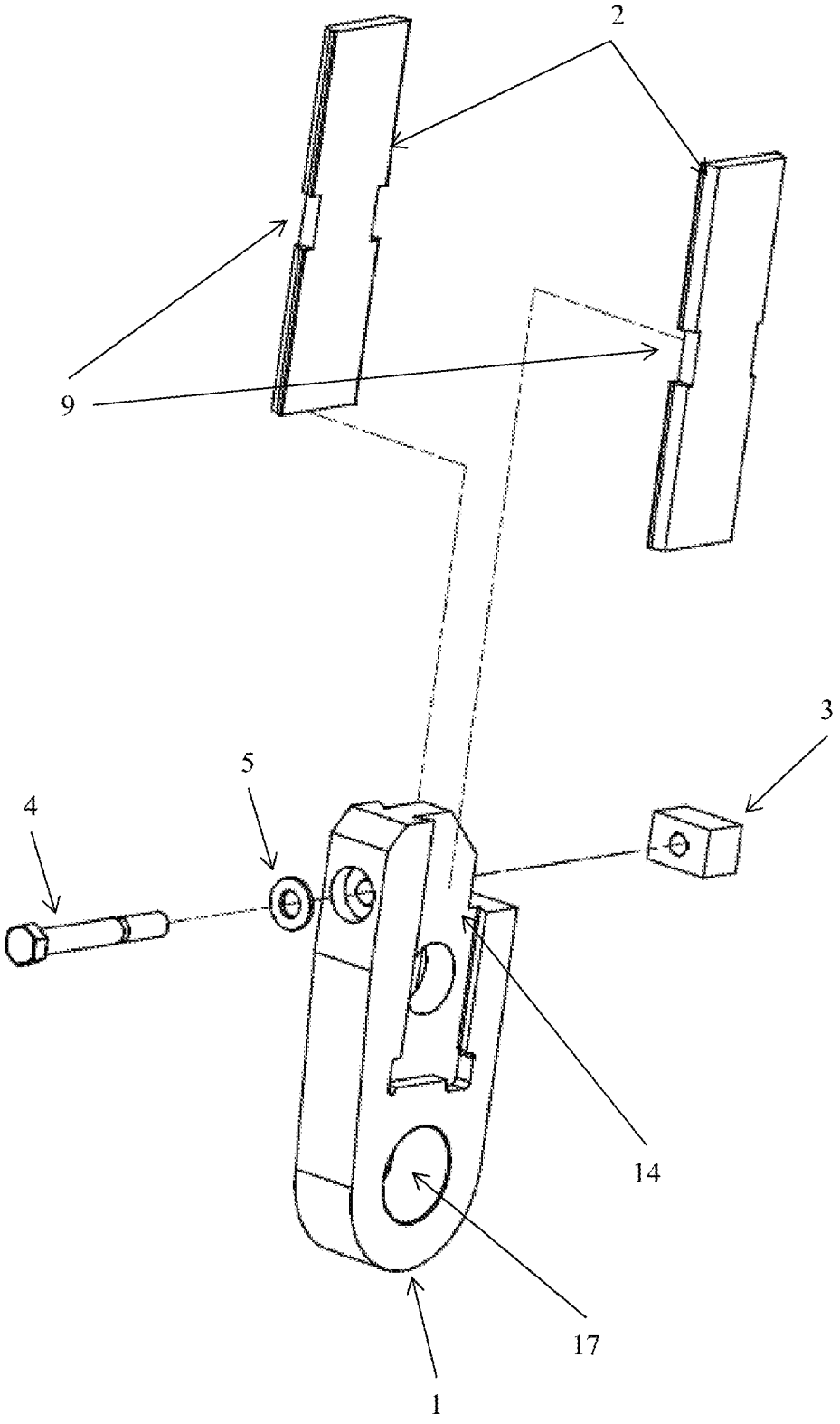
FIGS. 1-3 illustrates the hammer assembly and replaceable blade in an expanded view.

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figures, it is possible to see the various major elements constituting the apparatus of the present invention.

Now referring to Figures, one embodiment of the present invention is shown. The present invention is a hammer assembly 6 that will mount in a grinder/shredder/hammer mill type machine 7. Of the possible grinding/shredding/milling type machines 7 that this hammer assembly 6 could be used in, all of them have a rotating element 8 with pins to hold the hammer assembly 6 in place. Sometimes the hammer assembly 6 will have a single pin allowing the hammer to swing and sometimes two pins, make the hammer fixed.

The figures represent one embodiment of the present invention where a swing hammer is shown, but it should be appreciated that a fixed hammer is also taught as an alternative embodiment.

The hammer assembly of the present invention is comprised of a twin blade design where the blades 2 are reversible and interchangeable from one side to the other. A single lock-block 3 holds the blades 2 in place. A tool holder hammer body 1 with machined slots 14 and 15 to precisely locate and retain the blades 2 is required for attaching the blades 2 to the rotating element 8 of the machine. The present invention also reduces the size of the hammers, which provides more aerodynamic operation for reduced energy usage.

Figure 2:
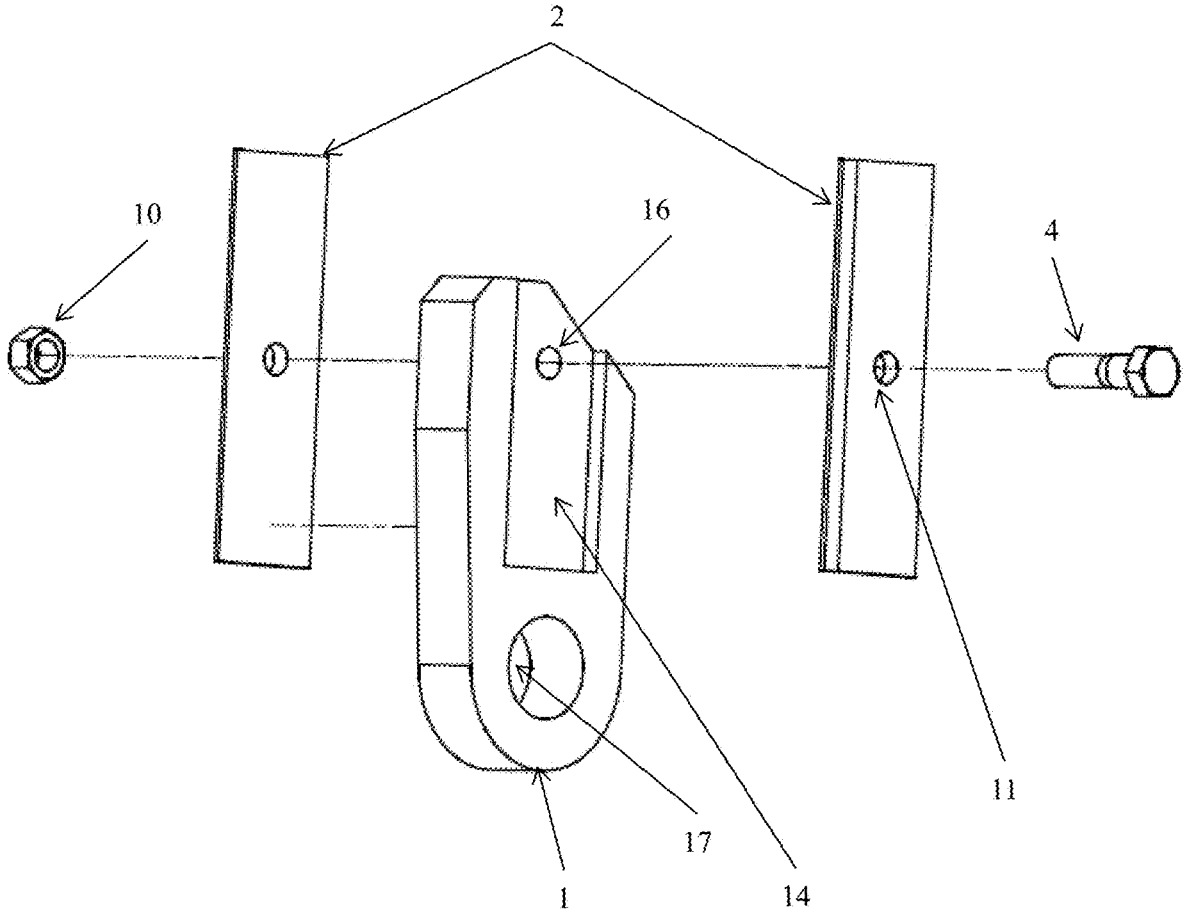
Figure 3:
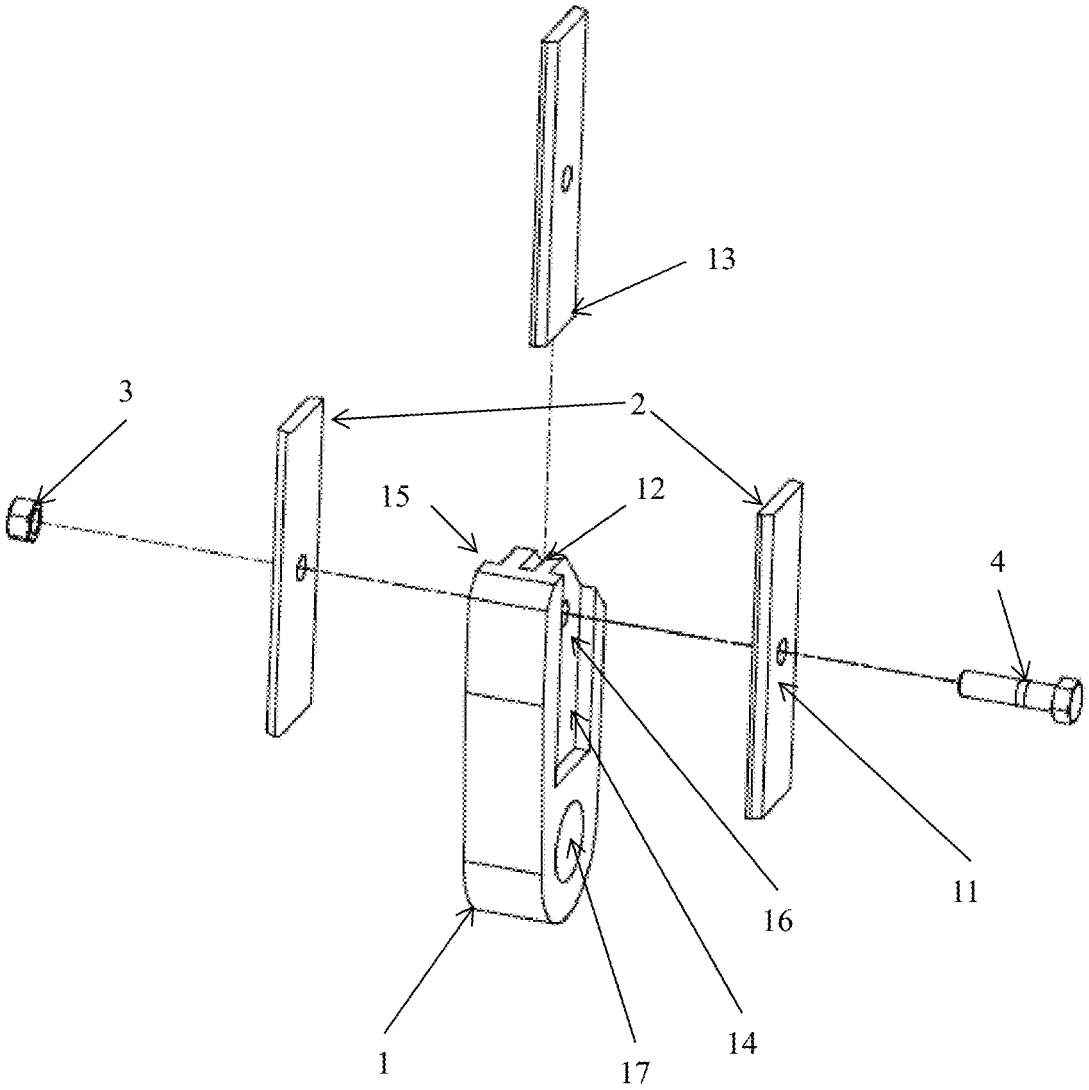

Now referring to FIGS. 1-3, the tool holder hammer body 1 and blades 2 of the present invention are shown. In FIG. 1, the tool holder hammer body 1 has a single bolt 4 and block 3 for retaining the two blades 2 slide into the recessed retaining area 14 and 15 machined into the tool holder hammer body 1. Once the blades 2 are slid into the tool holder hammer body 1, a corresponding slot 9 located approximately on the center of each blade 2 corresponds to the retaining block 3 that is secured to the tool holder hammer body 1 and retains the blades 2 in a fixed position.

In FIG. 2, a simple nut 10 and bolt 4 assemble going through a hole 11 in the center of a blade 2 secures the blade 2 to the tool holder hammer body 1, after the blade 2 is slide into the machined recess/slot 14 and 15 in the tool holder hammer body 1.

In FIG. 3, and triple blade embodiment is shown where the tool holder hammer body 1 has an additional machined recess 12 for holding a third blade 13 between the two blades 2 retained on the outer tool holder recesses 14 and 15. Again a simple nut 10 and bolt 4 assemble secures the three blades 2 and 3 in a fixed position to the tool holder hammer body 1 using a hole 11 in each blade 2 and 3 and a corresponding hole 16 in the tool holder hammer body 1 to locate and secure the blades 2 and 3 in position within the tool holder recesses 14, 15, and 12.

Figure 5:
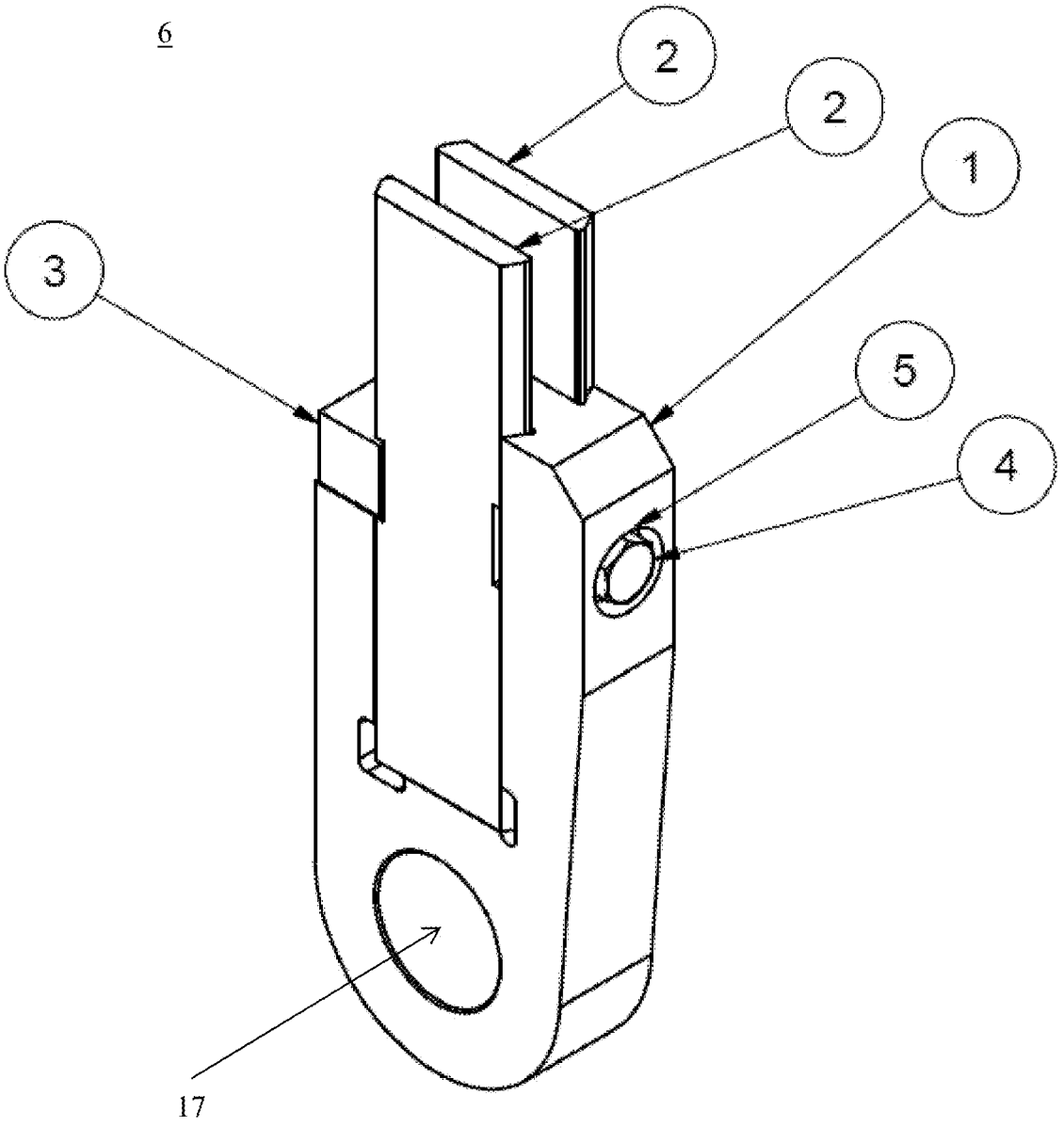
FIGS. 5-7 illustrate the hammer assembly and replaceable blade in an assembled state.
Figure 6:
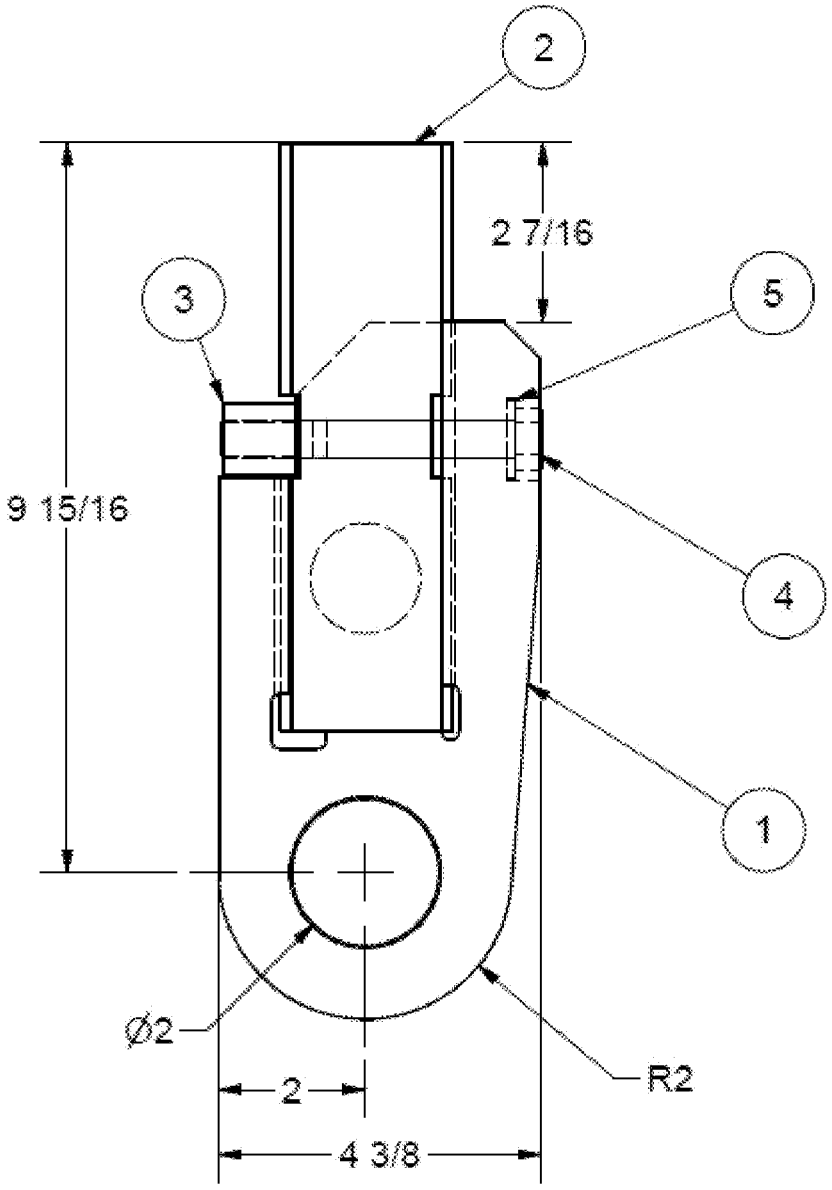
Figure 7:
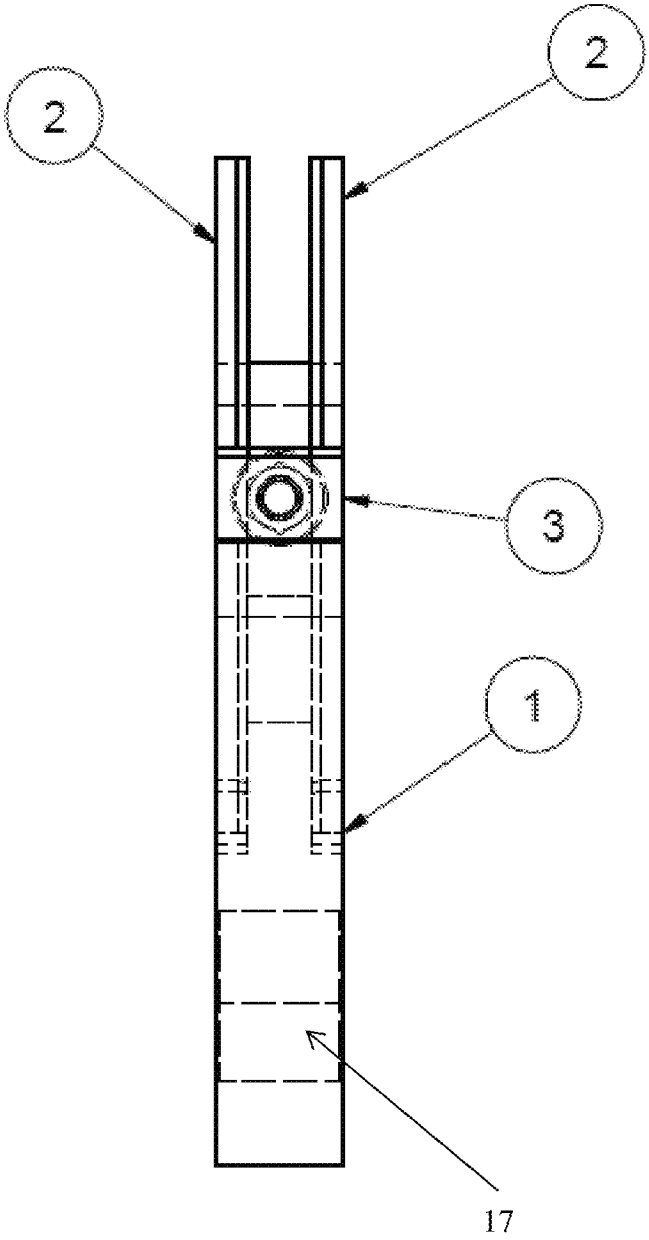

Referring to FIGS. 5-7, the components of the invention are shown. A hammer body 1 engages two or more blades 2 using a lock 3, hex head bolt 4 and flat washer 5.

Figure 4:
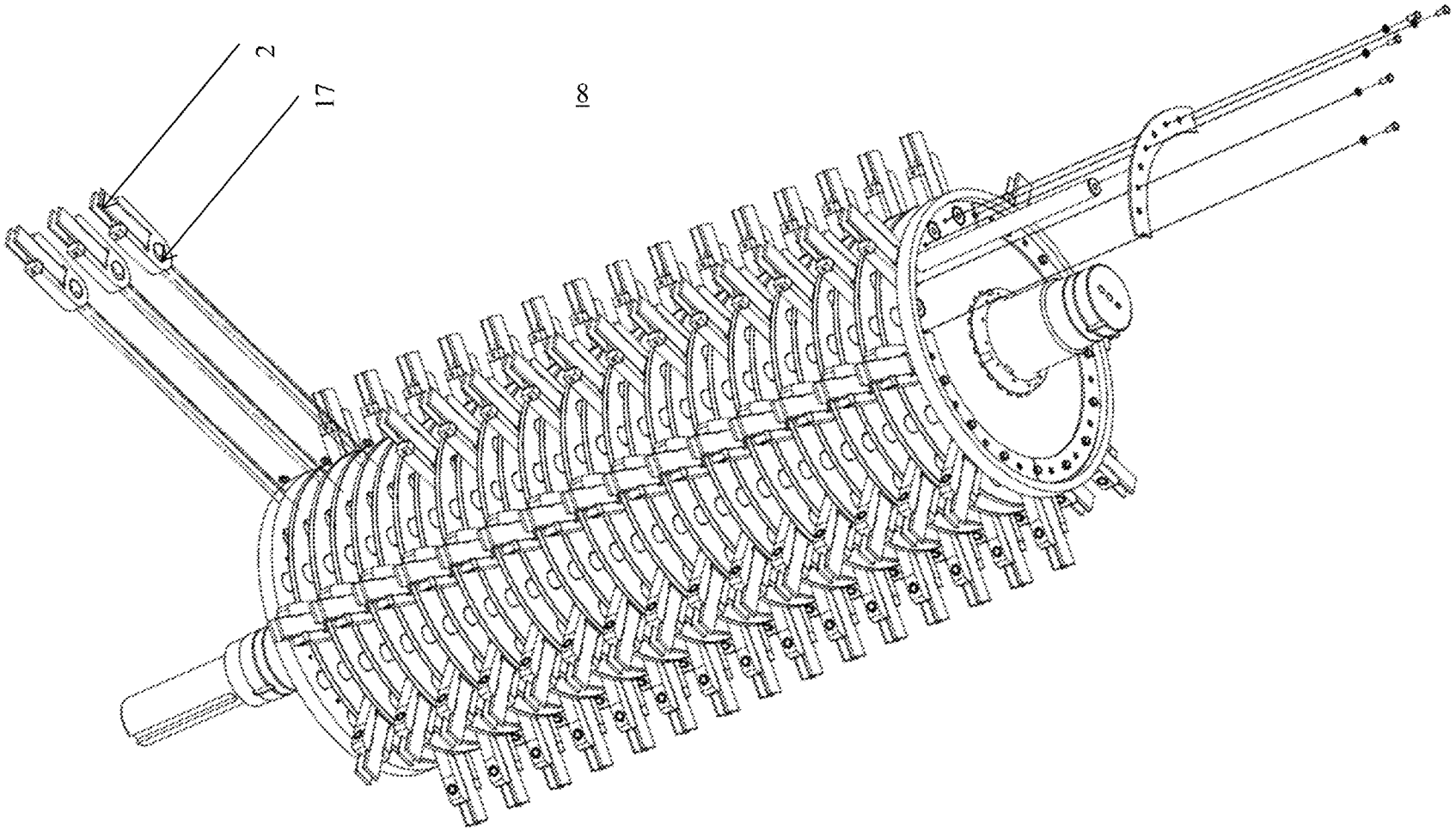
FIG. 4 illustrates the rotor assembly of the present invention.
Figure 8:
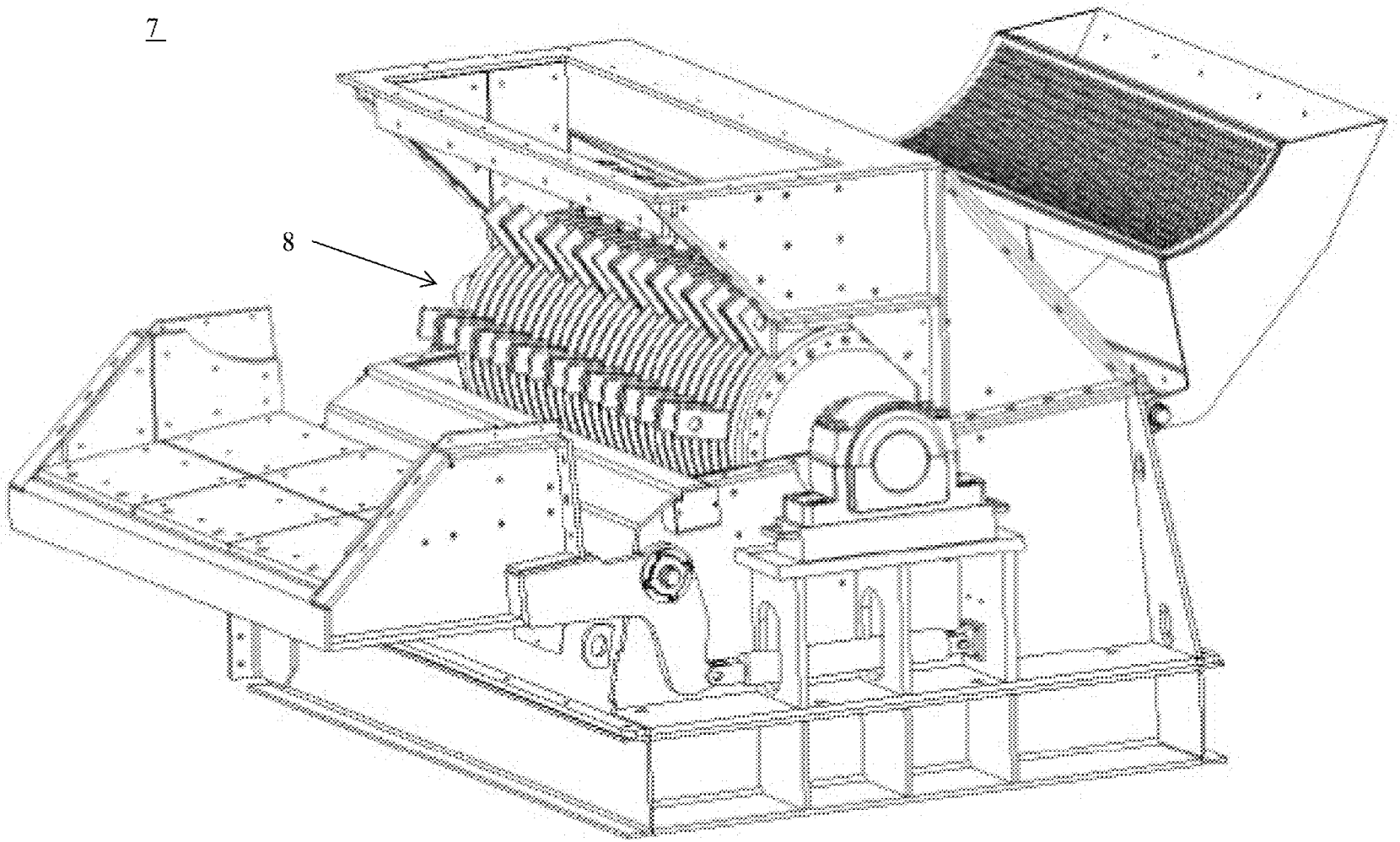
FIG. 8 illustrates a typical rotating hammer mill's rotor assembly using the tool holder and blades taught by the present invention.
Figure 9:
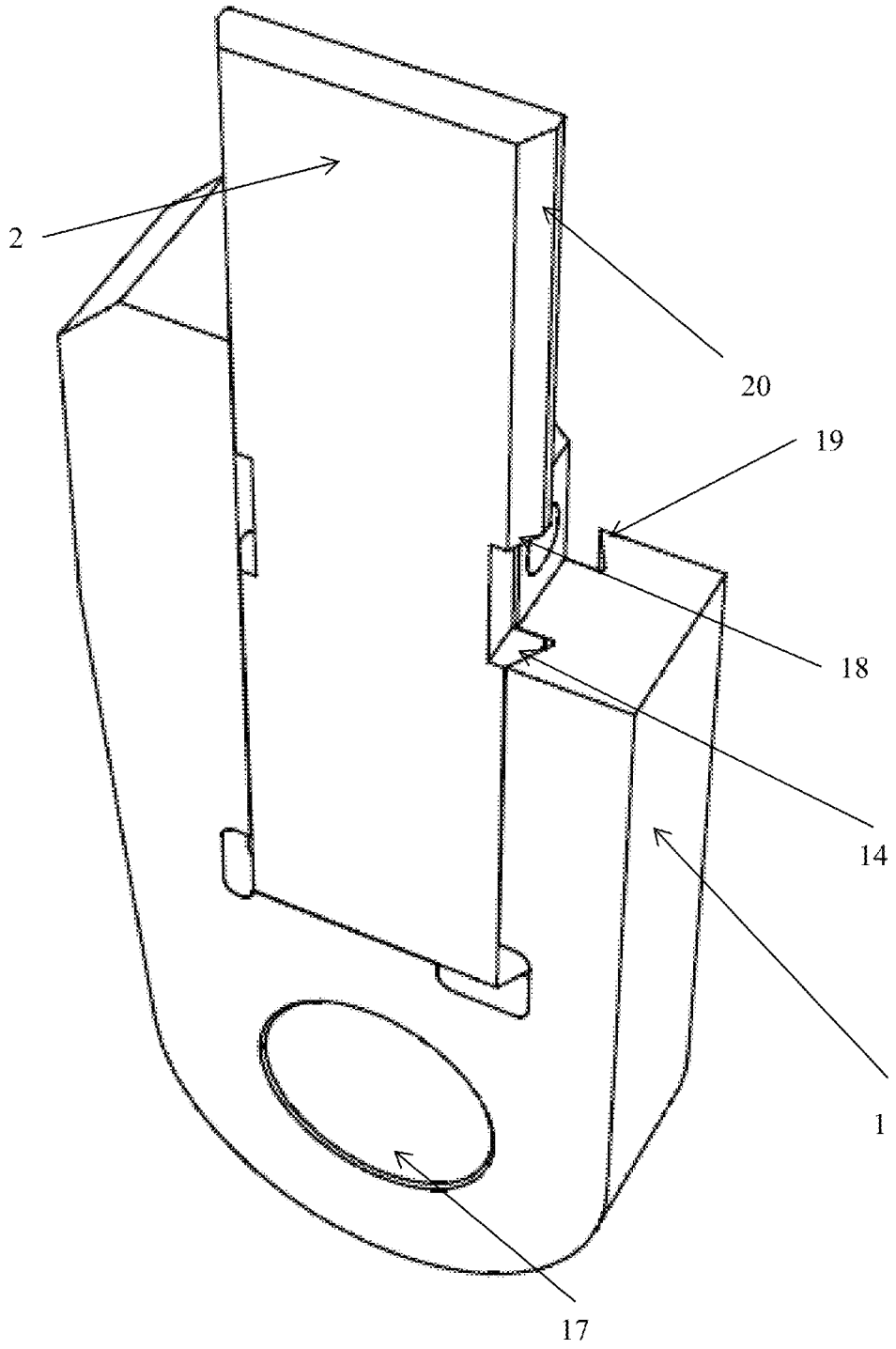
FIGS. 9-11 illustrate a prototype tool holder and blade in a partially assembled state.
Figure 10:
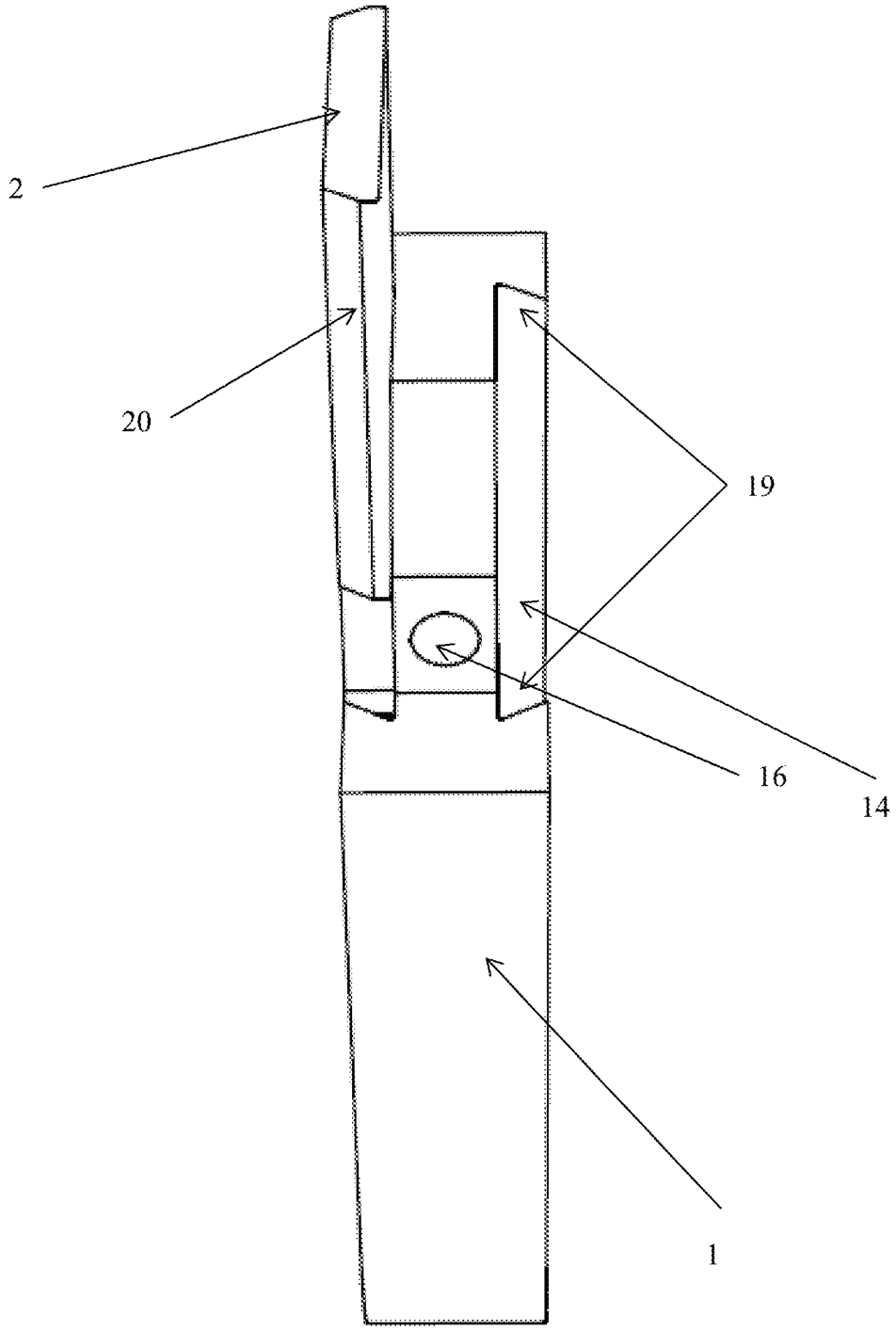
Figure 11:
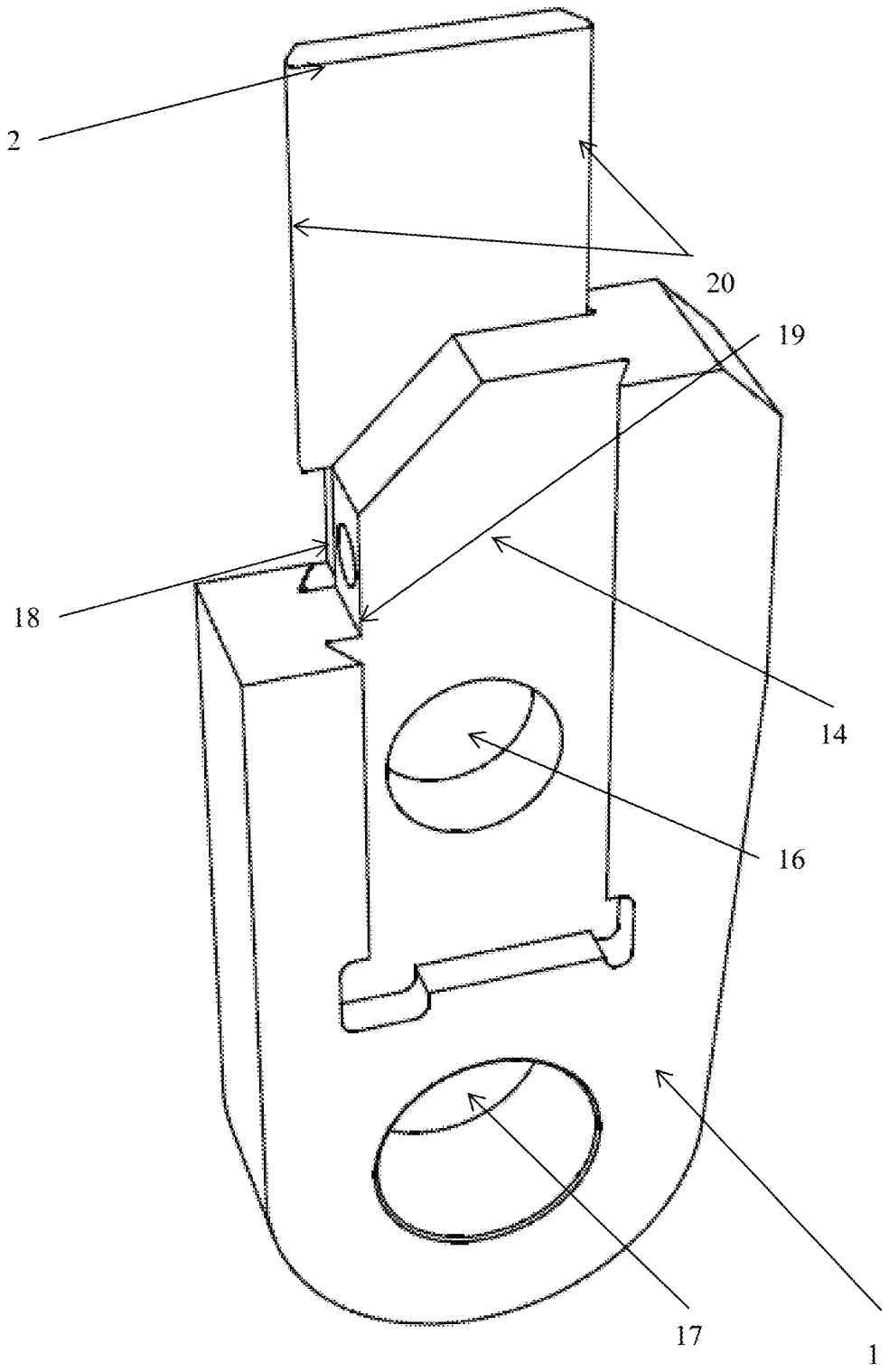
Figure 15:
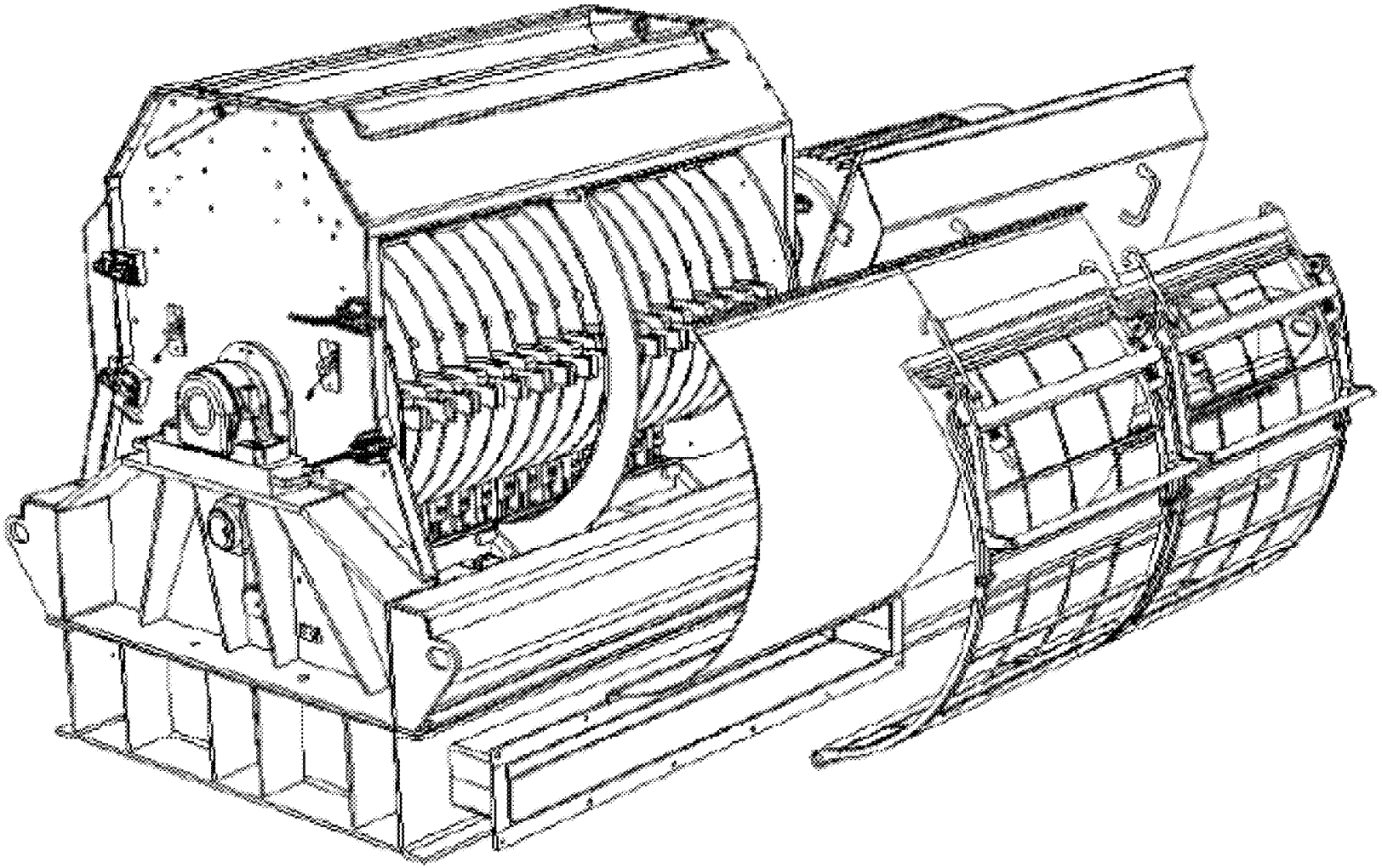
FIGS. 15-16 illustrate rotating hammer mills that the tool holder and blades taught by the present invention are to be attached to and used in the reduction process.
Figure 16:
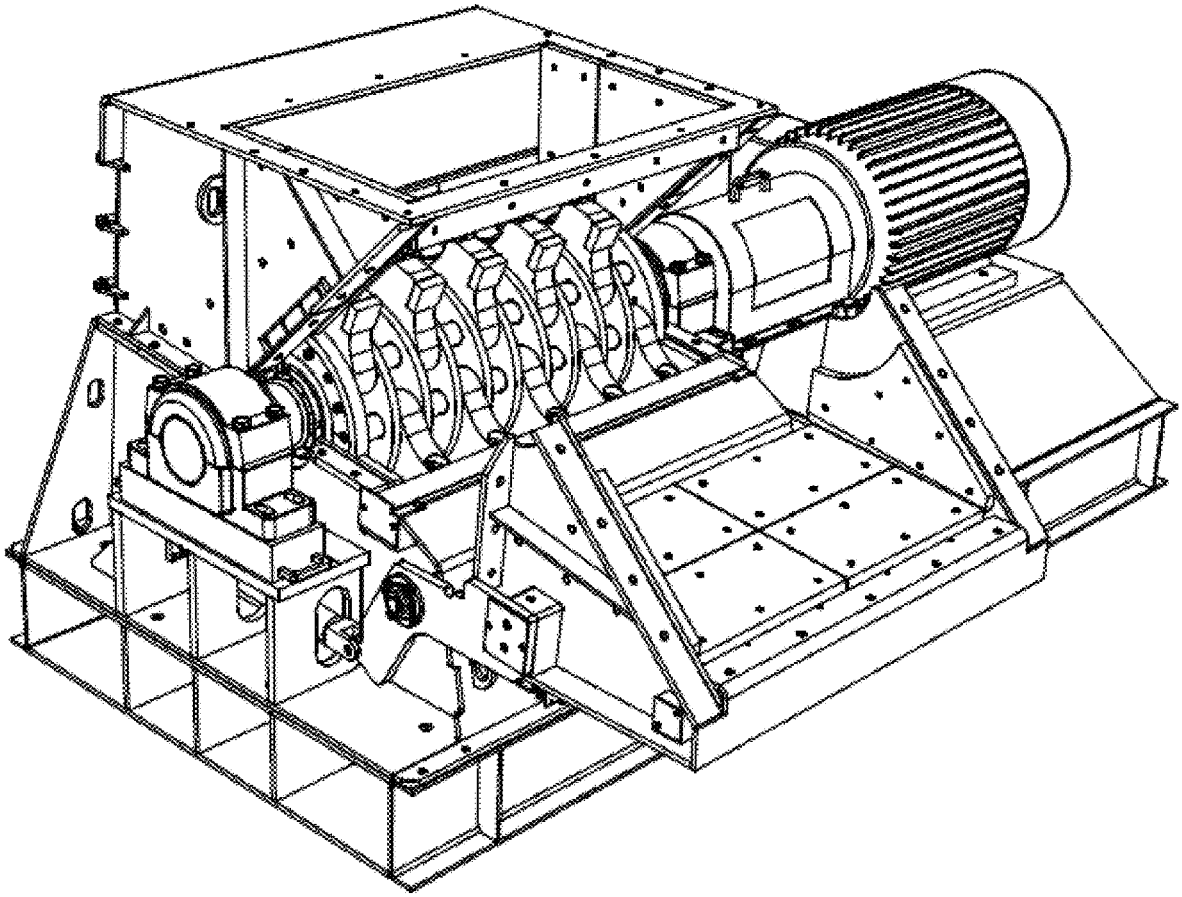

FIGS. 8 and 15 illustrate the typical rotating hammer mill 7 and rotating element 8 to which the tool holder hammer body 1 is attached. As shown in FIG. 4, the tool holder hammer body 1 is placed into a rotating element 8 and is secured to the rotating element by a large opening 17 on an opposing end of the tool holder hammer body 1 from where the blades 2 and 3 extend. Once secured to the rotating element 8 using the hole 17, the blades 2 and 3 are lined up in rows spaced around the rotating assembly 8 as shown in FIG. 8.

Figure 14:
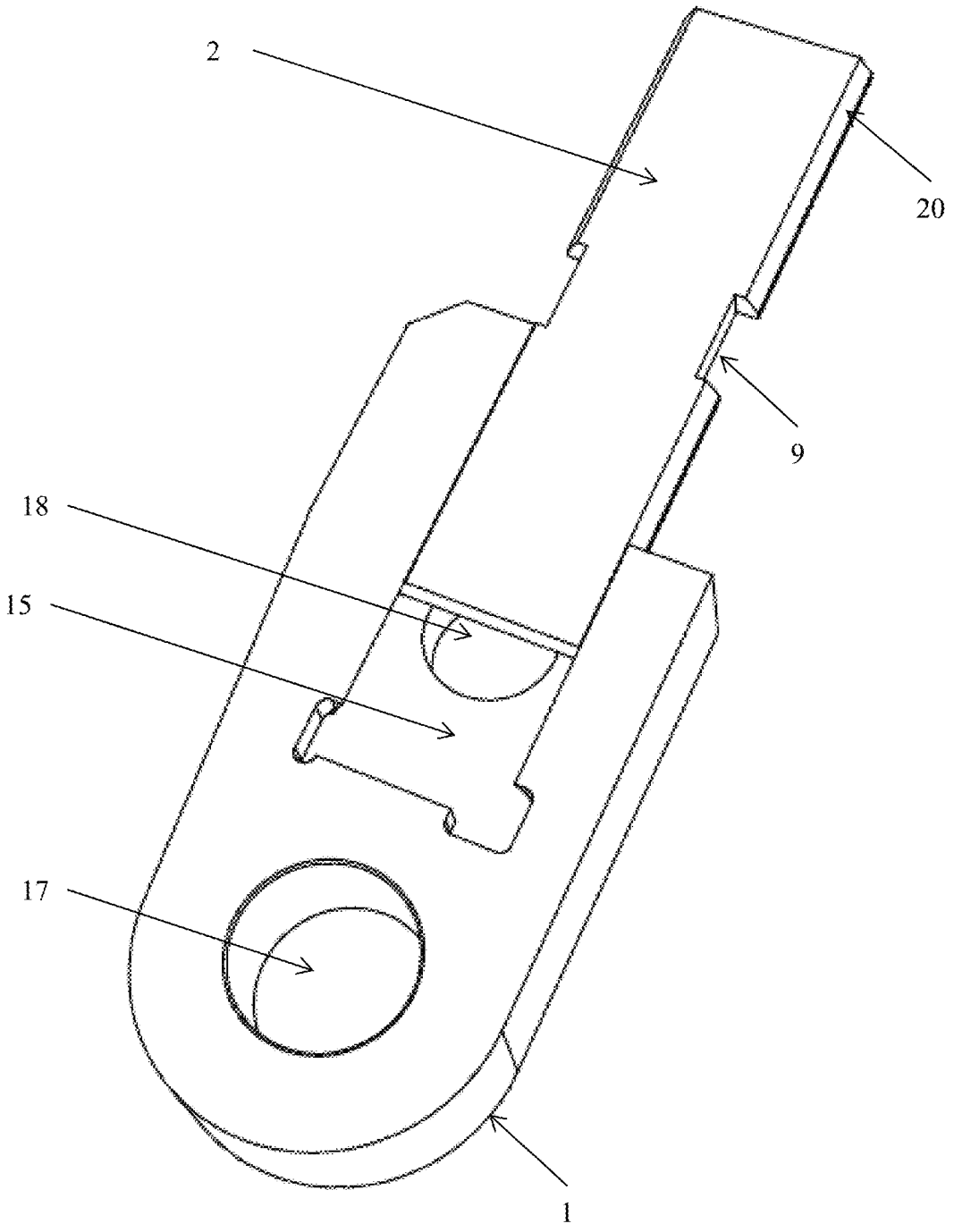
FIG. 14 illustrates a prototype tool holder and blade in a partially assembled state, showing how the blade is slide into the tool holder.

FIGS. 9-11 and 12 are photos of the physical prototype built for testing purposes. In the photos, the tool holder hammer body 1 and its blade retaining recesses 14 and 15 are clearly visible, as is the slot 18 for securing the retaining bolt 4 and nut 10. Also shown in these photos is the angular machine surface, which matches the angular machined surface of the blades 2. These angular machined surfaces 19 and 20 provide increased retaining force compared to a flat surface that would allow the blade to be set in place. By incorporating the angular surfaces 19 and 20, the blades 2 must be slid into the tool holder hammer body 1 as shown in FIG. 14 and they are more tightly secured and better held into position as the retaining force is spread across a much larger surface area, which greatly reduces the risk of a blade coming loose and damaging the rotating element 8 or coming off and causing damage to other blades and the rotating element 8, which could result in a costly repair.

Figure 12:
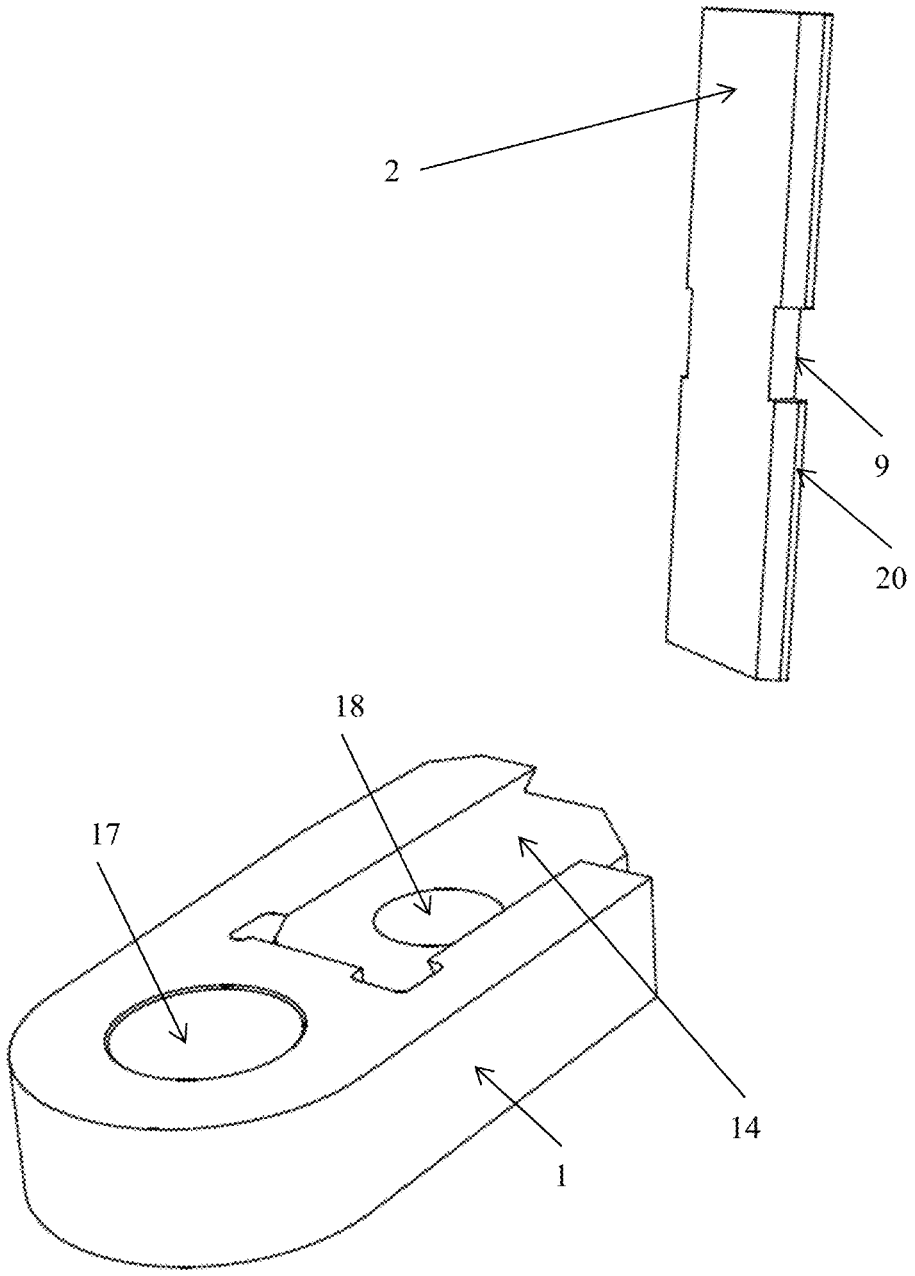
FIG. 12 illustrates the blade taught by the present invention for use in combination with the tool holder.
Figure 13:
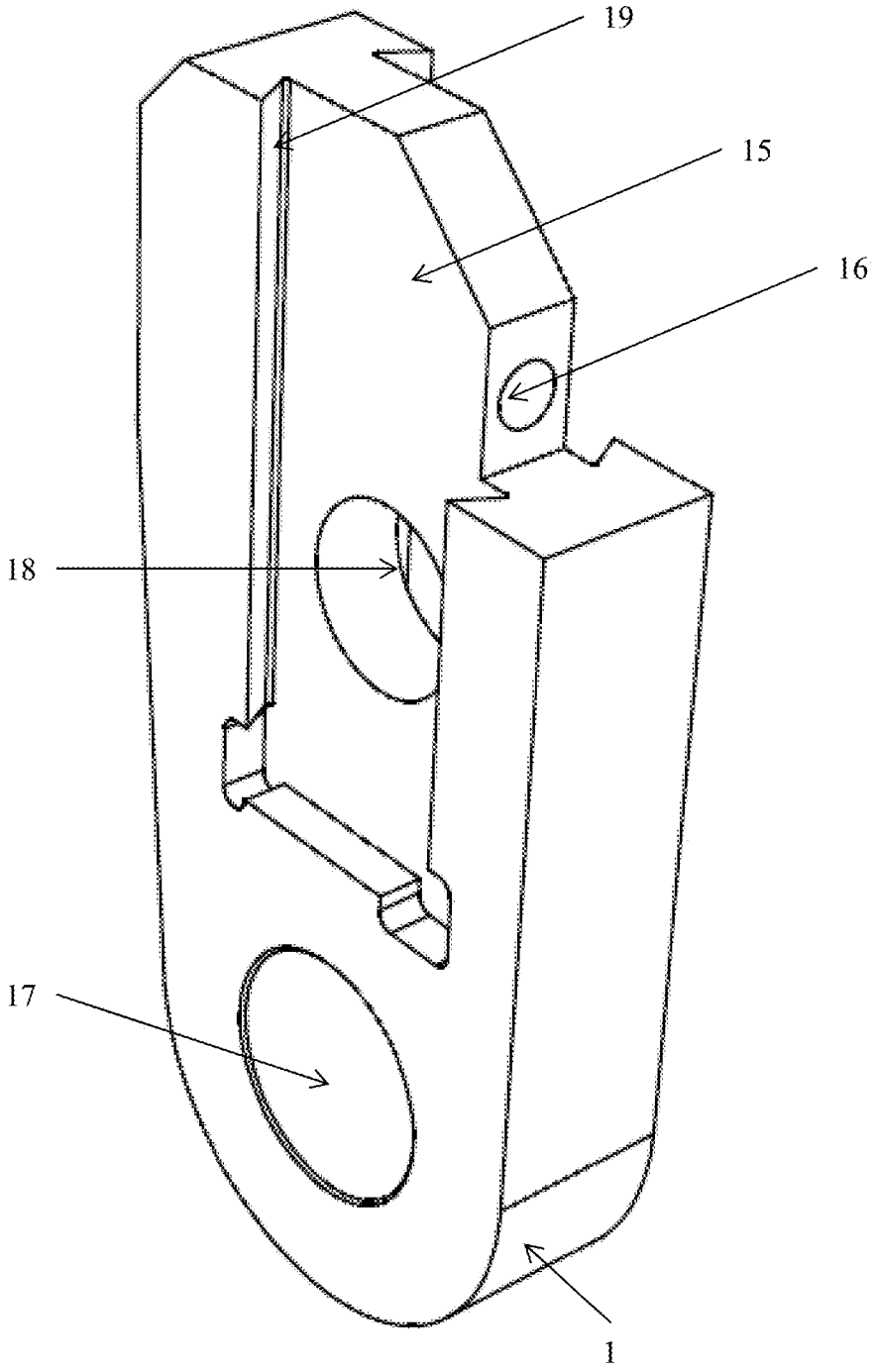
FIG. 13 illustrates the tool holder taught by the present invention for use in combination with the blade.

FIG. 12 shows the angular cut on the blade 20 which serves not only to increase reduction during operation, but also engages the tool retainer's angular surfaces 19. The securing notice 9 which engages the bolt 4 and block 3 for securing the blade 2 in the tool holder hammer body 1 is also readily shown in this illustration.

In use, the swinging hammer mounts in a size reduction machine such as a hammer mill with a rotating assembly. These machines use swinging hammers as cutting/crushing implements. The new twin blade hammer design of the present invention is a unique device for increasing the amount of tooling by attaching two reversible/removable blades 2 to a swinging hammer/tool holder hammer body 1.

Unique features include a milled dovetail/angular slots 19 along each side of the hammer tool holder hammer body 1. The tool holder hammer body 1 features a slot or shoulder 19 that allows the tool/blade 2 to be supported from shock-loading while grinding material. The tool holder hammer body 1 and slot or shoulder 19 also allows a milled blade edge 19 to slide in to place and be securely held in position. The simple milled slot 9 located in the middle of each blade 2 that allows a single mounting block 3 and bolt 4 to securely hold each blade 2 in position. This results in the ability to rotate and/or interchange blades 2 to get up to four wear surfaces per blade 2.

In an alternative embodiment, the hammer/tool holder hammer body 1 is fixed using two pin holes versus the single pin hole 17 used on a swinging hammer as show in the figures.

Finally, the hammer/tool holder hammer body 1 of the present invention is shorter than normal—to allow the blades to extend up and into the cutting area whereas the prior art teaches the use of a simple rectangular plate with a hole in the end, and then sliding a hammer pin in/out to remove the hammers. The twin blade 2 of the present invention allows the hammer/tool holder hammer body 1 to remain on the hammer pin, and one simply removes a bolt 4 and retaining block 3 to remove the hammer—no pulling of hammer pins. Therefore the present invention is a much quicker, safer, and less costly to maintain compared to the prior art machines.

Figure 17:
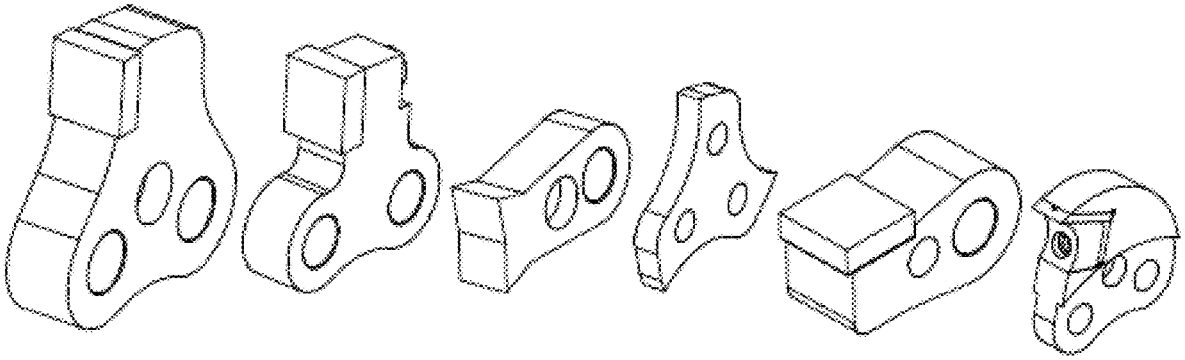
FIG. 17 illustrates various hammer designs that may be used in the tool holder of the present invention.

FIG. 17 illustrates various hammer shapes that may be incorporated by the present invention in place of the blades as shown.

The present invention can be differentiated from the prior art systems with respect to a focus on the tool holder that allows single or multiple blade/hammer inserts to be installed without having to remove a hammer pin, so the tool holder stays in the machine, and the blades can be easily removed. In the present invention, a user can simply remove a single bolt and retention block and then flip or rotate the hammer to get additional wear surfaces or install new blades.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. A tool holder for use in a grinder/shredder/hammer mill type machine comprising:

a tool holder body;

the tool holder body having machined recesses in the form of a slot or shoulder for retaining one or more blades;

two or more blades secured to the tool body;

the blades having a corresponding slot or shoulder located approximately on the center of each blade corresponds to a retaining block that is secured to the tool holder and retains the blades in a fixed position;

a single bolt; and a washer.

2. The device of claim 1, wherein once the blades are slid into the tool holder, a corresponding slot located approximately on the center of each blade corresponds to the retaining block that is secured to the tool holder and retains the blades in a fixed position.

3. The device of claim 1, further comprising the tool holder has an additional machined recess for holding a third blade between the two blades retained on the outer tool holder recesses; and a simple nut and bolt assemble secures the three blades in a fixed position to the tool holder assembly using a hole in each blade and a corresponding hole in the tool holder to locate and secure the blades in position within the tool holder.

4. The device of claim 1, wherein the tool holder is placed into a rotating element and is secured to the rotating element by a one opening on an opposing end of the tool holder from where the blades extend; and once secured to the rotating element using the one hole, the blades are lined up in rows spaced around the rotating assembly in a swinging position.

5. The device of claim 1, wherein the tool holder is placed into a rotating element and is secured to the rotating element by a two openings on an opposing end of the tool holder from where the blades extend; and once secured to the rotating element using the two holes, the blades are lined up in rows spaced around the rotating assembly in a fixed position.

6. The device of claim 1, wherein an angular machine surface, which matches the angular machined surface of the blades;

this angular machined surface provides increased retaining force compares to a flat surface that would allow the blade to be set in place; and incorporating the angular surface, the blades must be slid into the tool holder and they are more tightly secured and better held into position.

7. The device of claim 6, wherein the angular cut on the blade serves not only to engage the tool retainer, but also to provide four sides for cutting/reduction when rotated within the tool holder as one surface wears out.

8. The device of claim 7, wherein a milled dovetail/angular slot along each side of the hammer tool holder, that allows a milled blade to slide in to place and be securely held in position;

a milled slot located in the middle of each blade that allows a single mounting block/bolt to securely hold each blade in position; and this results in the ability to rotate and/or interchange blades to get up to four wear surfaces per blade.

9. A hammer device comprising:

a hammer body;

the hammer body containing, one pin hole;

two recesses for retaining blades on the opposing end of the pin hole;

two or more blades;

a lock;

a hex head bolt; and a flat washer.

10. The hammer device of claim 9, wherein the hammer/tool holder is fixed using two pin holes versus the single pin hole used on a swinging hammer.

11. The hammer device of claim 9, wherein the hammer/tool holder of the present invention is shorter than normal to allow the blades to extend up and into the cutting area.

12. The device of claim 9, further comprising the tool holder body having machined recesses in the form of a slot or shoulder for retaining one or more blades; and the slot or shoulder allows the tool/blade to be supported from shock-loading while grinding material.

* * * * *